United States Patent [19]

Poirier

[11] 4,138,870

[45] Feb. 13, 1979

[54] LOCK CYLINDER PLUG STOP

[75] Inventor: Armand C. Poirier, Windsor, Conn.

[73] Assignee: Emhart Industries, Inc., Hartford, Conn.

[21] Appl. No.: 814,208

[22] Filed: Jul. 11, 1977

[51] Int. Cl.[2] ..... E05B 15/00

[52] U.S. Cl. ..... 70/372; 70/DIG. 62

[58] Field of Search ..... 70/370, 372, 373, 375, 70/451, DIG. 62

[56] References Cited

U.S. PATENT DOCUMENTS

| | | | |
|---|---|---|---|
| 1,487,900 | 3/1924 | Teich | 70/367 |
| 1,598,551 | 8/1926 | Brauning | 70/367 |
| 2,804,765 | 9/1957 | Biblin | 70/372 |
| 3,439,516 | 4/1969 | Quillen | 70/383 |

*Primary Examiner*—Robert L. Wolfe

*Attorney, Agent, or Firm*—McCormick, Paulding & Huber

[57] ABSTRACT

A lock cylinder having a key plug stop comprising an elongated arcuately formed wire received in an annular groove in the key plug. One end portion of the wire stop is retained in a slot in the cylinder shell. Opposite end portions of the stop are disposed in the path of the key and cooperate with the key to limit rotation of the plug relative to the cylinder shell. The stop may be assembled with the plug in either of two positions to selectively limit angular movement of the plug in either a clockwise or counterclockwise direction from a key withdrawal position.

10 Claims, 9 Drawing Figures

LOCK CYLINDER PLUG STOP

BACKGROUND OF THE INVENTION

This invention relates in general to lock cylinders and deals more particularly with improvements in lock cylinders of the type which include a key plug stop for limiting rotation of a key plug relative to a cylinder shell.

A lock cylinder of the aforedescribed character is commonly used to operate an associated locking mechanism which may be actuated by less than one full rotation of a key. Such a lock cylinder may, for example, have a key plug arranged for 90° or 180° rotation between a shed or key withdrawal position and a lock operating position. Heretofore, various stop mechanisms have been provided for limiting rotation of a key — key plug combination in such lock cylinders. One common form of stop comprises a pin which is mounted in fixed position on the cylinder shell and which projects into the shell bore between and in the path of a pair of angularly spaced abutment surfaces on the key plug. Another common form of stop includes an operating cam mounted in fixed position on the inner end of the key plug and arranged for rotation between fixed abutments associated with the inner end of the cylinder shell. While such key plug stops are generally satisfactory, one or more lock cylinder parts which comprise a stop mechanism usually must be handed to provide limited key plug rotation in a selected operating direction. Thus, the lock manufacturer may be required to maintain inventory of right and left-handed parts to facilitate assembly of lock cylinders for either clockwise of counterclockwise operation, as necessary for operation of various locking mechanism with which the lock cylinder may be used. Further, it may be necessary for the manufacturer to furnish each lock cylinder in a variety of axial lengths to satisfy various mounting requirements, all of which tends to further increase the parts inventory which must be maintained to enable assembly of locks to satisfy specific mounting and operating requirements.

Accordingly, it is the general aim of the present invention to provide an improved low cost stop mechanism which utilizes non-handed parts and which may be assembled as required to provide limited key plug rotation in either clockwise or counterclockwise direction.

SUMMARY OF THE INVENTION

In accordance with the invention a key operated lock cylinder is provided which has a key plug supported for rotation in a cylinder shell and an elongated stop member disposed between the plug and the shell. One end portion of the stop member is retained in fixed position by the shell. The opposite end portion of the stop member is angularly spaced from its one end and disposed in the path of the key — key plug combination for limiting rotation of the latter combination relative to the cylinder shell.

DETAILED DESCRIPTION OF PREFERRED EMBODIMENTS

Figure 1:
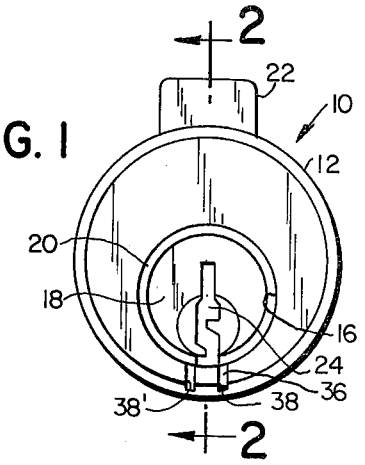
FIG. 1 is a front view of a lock cylinder embodying the invention.

The present invention may be practiced with any lock unit which includes a key plug to be supported for limited rotation in a lock housing. In the drawing the invention is illustrated with reference to a lock cylinder indicated generally by the reference numeral 10. The lock cylinder 10 generally comprises a lock housing or cylinder shell 12 which has a bore 14 and a counterbore 16 at the outer end of the bore. A cylindrical key plug 18 is supported for rotation in the bore 14 and has an enlarged head 20 at its outer end received within the counterbore 16. A cam 22 mounted in fixed position on the inner end of the key plug 18, to rotate with the plug, may be used to operate any suitable locking mechanism.

The key plug has an axially extending keyway 24 formed therein which opens radially outwardly through its peripheral surface. The keyway is adapted to receive a key 26 which positions a plurality of conventional pin tumbler assemblies 28, 28 to unlock the lock cylinder 10. The key 26 has an elongated blade 27 which includes a bitted edge 29 and an unbitted edge 31. The latter tumbler assemblies include pin tumblers and drivers which are separable along a shear line between the key plug and cylinder shell to free the plug for rotation relative to the shell in a conventional manner. The key plug 18 also has a radially outwardly opening annular groove 30 formed in its enlarged head 20.

In accordance with the present invention an elongated stop member, indicated generally at 32, is provided for limiting rotation of the key plug 18 relative to the cylinder shell 12. The stop member 32 is supported between the plug and shell and may be arranged to limit rotation of the key plug 180 degrees in either a clockwise or counterclockwise direction from a key withdrawal or shed position of the key, the latter position of the key being shown in FIGS. 2 and 3, to an operating position shown in FIG. 4. However, as illustrated, the stop member 32 is arranged to limit the key and the key plug for 180 degree rotation in a clockwise direction from the shed position of FIG. 3.

Figure 5:
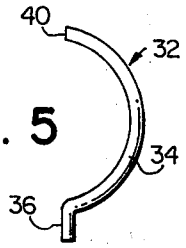
FIG. 5 is a somewhat enlarged front view of the stop member of the lock shown in FIGS. 1–4.

Considering the stop member 32 in detail and referring further to FIG. 5, the stop member is preferably formed from resilient wire and has an elongated arcuate portion 34 which is loosely received with the annular groove 30 between the plug and the shell. The stop member further includes a generally radially disposed end portion 36 engaged within a slot 38 formed in the outer end of the cylinder shell 12. The latter slot opens outwardly in general alignment with one side of the keyway 24 when the key plug is in its shed position. A second slot 38′ formed in the shell 12 in alignment with the other side of the keyway in its shed position provides an alternate mounting position for the end portion 36, as will be hereinafter further discussed. The arcuate portion 34 has a free end 40 disposed approximately at 12 o'clock position and in the path of the key — key plug combination.

The stop member 32 is assembled with the key plug 18 before the plug is fully inserted into the shell bore 14. The end portion 36 is engaged within the slot 38 as the key plug is moved into its assembled position in the cylinder shell 12. Thereafter, the cam 22 is secured to the inner end of the plug to retain the plug in assembly with the shell.

Figure 2:
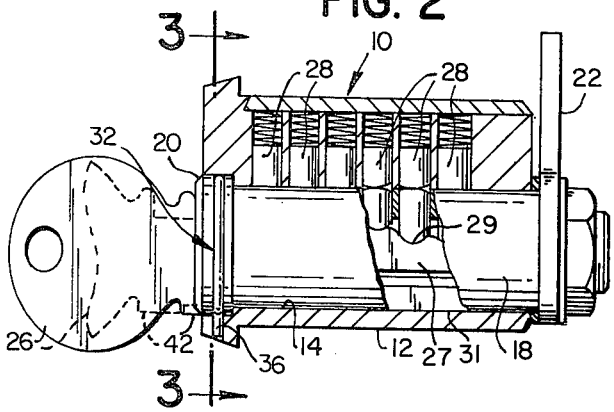
FIG. 2 is a sectional view taken generally along the line 2—2 of FIG. 1 and shows the lock with a key therein.

When the key plug 18 is in its shed position, as it appears in FIG. 1, the key 26 may be inserted into the keyway 24 to move the tumbler assemblies 28, 28 to unlock position, as shown in FIG. 2. Thereafter the key — key plug combination may be rotated in clockwise direction from its position of FIG. 3 to its position of FIG. 4 wherein a tab 42 on the key blade generally adjacent the unbitted edge 31, best shown in FIG. 2, engages the end portion 40 to arrest key rotation in clockwise direction. Reverse rotation of the key 26 from its position of FIG. 4 to its position of FIG. 3 brings the opposite side of the tab 42 into engagement with the end portion 36 when the key 26 reaches it shed position. The arrangement of the stop member 32 within the enlarged head 20, as hereinbefore described, is particularly suitable for a lock cylinder which has a cylinder shell of relatively short axial length and which must accommodate a plurality of pin tumbler assemblies 28, 28. The aforedescribed stop member arrangement does not reduce the effective usable length of the key plug, thereby enabling the key plug to accommodate the maximum possible number of pin tumbler assemblies 28, 28.

Figure 3:
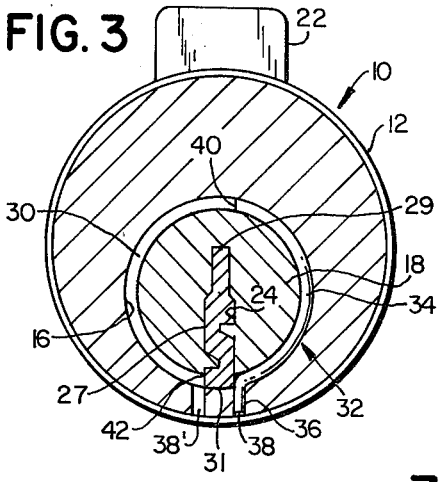
FIG. 3 is a somewhat enlarged sectional view taken along the line 3—3 of FIG. 2 and shown with the key plug in key withdrawal position.
Figure 4:
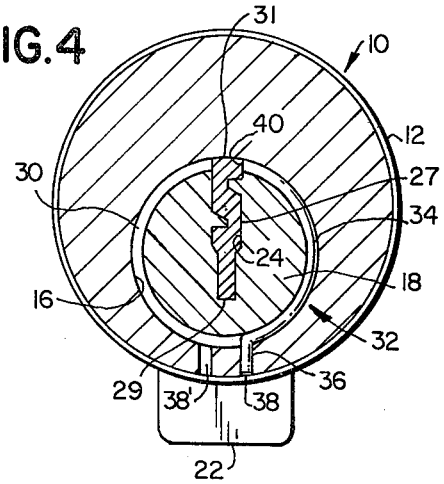
FIG. 4 is similar to FIG. 3, but is shown with the key plug rotated to its limit in a clockwise direction.

When the key plug is to be arranged for counterclockwise rotation from its shed position the stop member 32 is assembled within the left hand portion of the groove 30, as viewed in FIGS. 1, 3 and 4, and the end portion 36 is engaged within the slot 38′. Thus, the lock cylinder 10 may be assembled for either clockwise or counterclockwise key operation by selectively positioning the stop member 32.

Figure 6:
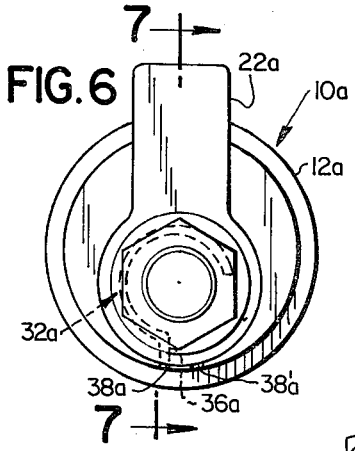
FIG. 6 is a rear view of another lock cylinder embodying the invention.
Figure 7:
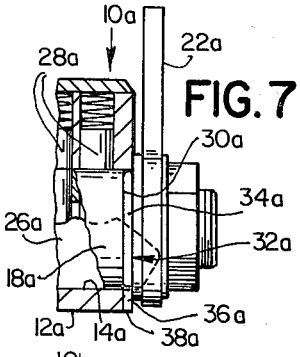
FIG. 7 is a fragmentary sectional view taken generally along the line 7—7 of FIG. 6.
Figure 8:
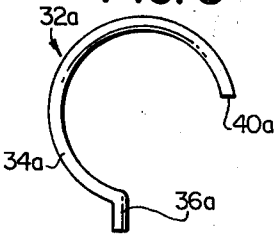
FIG. 8 is a somewhat enlarged rear view of the stop member of the lock shown in FIGS. 6 and 7.

If space is available within the inner end of the lock cylinder shell the stop member may be retained within the inner end of the shell. Another lock cylinder 10*a* which illustrates another embodiment of the invention wherein the stop member is mounted in the inner end of the cylinder shell as shown in FIGS. 6 and 7. Each part of the lock cylinder 10*a* which corresponds to a part of the previously described lock cylinder 10 bear the same reference numerals as the previously described part with a letter "a" suffix and may not be hereinafter described in detail.

Further considering the lock cylinder 10*a* it has a cylinder shell 12*a* and a key plug 18*a* received within a bore 14*a* formed in the cylinder shell. The key plug has an axially and radially outwardly opening groove 30*a* in its inner end. A stop member 32*a* which is preferably formed from resilient wire, is received within the groove 30*a* and has an elongated portion 34*a* which surrounds an associated portion of the key plug 18*a*. The stop member 32*a* also has a generally radially disposed end portion 36*a* received in an associated slot 38*a* formed in the cylinder shell 12*a*. A cam 22*a* mounted in fixed position on the inner end of the key plug 18*a* cooperates with the plug and the cylinder shell to retain the plug in assembly with the shell and to retain the stop member 32*a* in position with the bore 14*a*.

As illustrated the stop member 32*a* is arranged to engage a side portion of the key blade to limit the key — key plug combination for rotation 90° in a clockwise direction, as viewed from the outer end, between a shed position and an operating position. The elongated portion 34*a* extends generally around an associated portion of the key plug 18*a* for some 270 degrees. As viewed in FIG. 6 the elongated portion 34*a* extends from the slot 38*a*, which is located at approximately a six o'clock position in the shell 12*a*, to approximately a nine o'clock position. The elongated portion 34*a* has an inside diameter somewhat larger than the outside diameter of an associated surface of the groove 30*a* so that it is loosely received within the groove. This arrangement eliminates the risk that the resilient wire stop member 32*a* will exert a spring clutch action on the key plug 18*a* thereby binding on the plug to resist plug rotation direction or from the operating position to the shed position as viewed in 6.

As previously described, the stop member 32*a* may be assembled in a reverse position within the illustrated lock cylinder 10*a* to limit key plug rotation in a reverse or counterclockwise direction from a shed position to an operating position. A slot 38*a*′ formed in the inner end of the cylinder shell 12*a* facilitates such reverse assembly.

Figure 9:
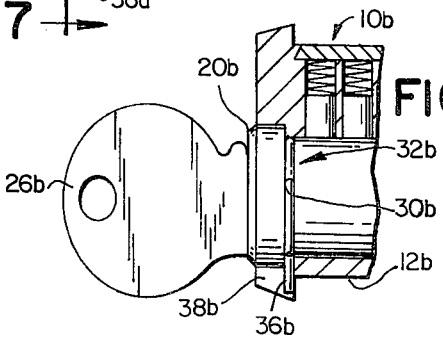
FIG. 9 is a fragmentary sectional view similar to FIG. 2, but shows still another lock cylinder embodying the invention.

FIG. 9 illustrates still another lock cylinder embodying the present invention and indicated generally at 10*b*. The lock cylinder 10*b* is similar in most respects to the lock cylinder 10 previously described, and differs therefrom only in the arrangement of the stop member 32*b*. The latter member is received within an annular groove 30*b* formed in the key plug 18*b* immediately inwardly of its enlarged head 20*b*. The stop member 32*b* is arranged to engage the sides of the key blade to limit rotation of the key-keyplug combination. When the stop member is supported by the key plug in the manner illustrated in FIG. 9 it is not necessary to provide a tab on the key, such as the tab 42 illustrated in FIG. 2, since the stop member is directly engageable with associated side portions of the key blade.

I claim:

1. In a lock cylinder including a shell, a key plug supported for rotation in said shell and having a keyway therein, a key for insertion into said keyway and for rotating said key plug from a key shed position and relative to said shell, and an elongated wire stop member having one end portion retained in fixed position by said shell and an elongated arcuate portion disposed between said plug and said shell and having a free end angularly spaced from said one end and engageable with said key plug-key combination to limit its rotation in one direction relative to said shell, the improvement comprising said shell having a generally radially extending slot opening outwardly in a generally axial direction through an associated end of said shell, said one end portion extending outwardly in a generally radial direction from the end of said arcuate portion opposite said free end and being received within said slot and retained by said slot in fixed position relative to said shell.

2. A lock cylinder having a shell including a stepped cylindrical bore having a diametrically enlarged portion at its outer end, a generally radially extending slot communicating with said bore and opening outwardly in a generally axial direction through said outer end, a key plug supported for rotation in said bore and having a keyway therein, said plug having a diametrically enlarged head received in said outer end portion, said head having an annular groove therein, a key for insertion into said keyway and for rotating said key plug from a key shed position and relative to said shell, an elongated wire stop member having an arcuate portion received in said groove, said stop member having one end portion extending outwardly in a generally radial direction from an associated end of said arcuate portion and received in said slot and retained thereby in fixed position relative to said shell, said one end being engageable with said key in said shed position to prevent rotation of said key in one direction from said shed position, said arcuate portion having a free end opposite said associated end for engaging said key to limit rotation thereof from said shed position in a direction opposite said one direction.

3. In a lock cylinder as set forth in claim 1 the further improvement wherein said free end is engageable with said key.

4. In a lock cylinder as set forth in claim 3 the further improvement wherein said one end is engageable with said key in its shed position to prevent rotation of said key from said shed position in a direction opposite said one direction.

5. In a lock cylinder as set forth in claim 1, the further improvement wherein said shell includes a stepped cylindrical bore which has a diametrically enlarged portion at its outer end, said key plug has a generally cylindrical portion supported for rotation in said bore and includes an enlarged head received in said diametrically enlarged portion, and said elongated stop member is received within said diametrically enlarged portion.

6. In a lock cylinder as set forth in claim 5, the further improvement wherein said enlarged head has an annular groove therein and said arcuate portion is received within said groove.

7. In a lock cylinder as set forth in claim 1 the further improvement wherein said key plug has an annular groove which opens axially and radially outwardly through its inner end, said lock cylinder includes another member secured to said inner end of said key plug, and said other member cooperates with said key plug to retain it in assembly with said shell and to retain said arcuate portion of said stop member in said groove.

8. In a lock cylinder as set forth in claim 7 the further improvement wherein said other member comprises a cam secured to said key plug for rotation therewith.

9. In a lock cylinder as set forth in claim 3 wherein said key has an elongated blade which includes a bitted edge and an unbitted edge the further improvement wherein said free end is engageable with one side of said key blade at a position generally adjacent said unbitted edge.

10. In a lock cylinder as set forth in claim 9 the further improvement wherein said key includes a tab generally adjacent said unbitted edge and projecting therebeyond and said free end is engageable with said tab.

* * * * *

UNITED STATES PATENT OFFICE

CERTIFICATE OF CORRECTION

Patent No. 4,138,870 Dated February 13, 1979

Inventor(s) Armand Charles Poirier

It is certified that error appears in the above-identified patent and that said Letters Patent are hereby corrected as shown below:

Column 3, line 27, "it" should be --its--.

Column 4, line 3, "with" should be --within--.

Column 4, line 20, after "rotation" insert --in clockwise--.

Column 6, line 3, delete "elongated".

Signed and Sealed this

*Eighth* Day of *May 1979*

[SEAL]

*Attest:*

RUTH C. MASON
*Attesting Officer*

DONALD W. BANNER
*Commissioner of Patents and Trademarks*